United States Patent [19]

Schwarz

[11] 4,193,538

[45] Mar. 18, 1980

[54] APPARATUS FOR SEPARATING AND MEASURING SAMPLE COMPONENTS

[75] Inventor: Gerhard Schwarz, Munich, Fed. Rep. of Germany

[73] Assignee: Compur-Electronic Gesellschaft mit beschrankter Haftung, Munich, Fed. Rep. of Germany

[21] Appl. No.: 902,684

[22] Filed: May 4, 1978

[30] Foreign Application Priority Data

May 17, 1977 [DE] Fed. Rep. of Germany ..... 2722322

[51] Int. Cl.[2] ..... B04B 5/00

[52] U.S. Cl. ..... 233/26; 422/72

[58] Field of Search ..... 233/1 R, 26, 27, 1 B; 23/259, 292; 422/72

[56] References Cited

U.S. PATENT DOCUMENTS

| | | | |
|---|---|---|---|
| 2,179,839 | 11/1939 | Brosnan | 233/26 X |
| 3,009,388 | 11/1961 | Polanyi | 233/26 X |
| 3,168,473 | 2/1965 | Goda et al. | 233/26 |
| 3,567,113 | 3/1971 | Stansell et al. | 233/26 X |
| 4,052,165 | 10/1977 | Wienchol et al. | 233/26 X |

*Primary Examiner*—George H. Krizmanich

*Attorney, Agent, or Firm*—Stonebraker, Shepard & Stephens

[57] ABSTRACT

An account is given of a centrifuge apparatus with a plate-like rotor whose outer edge is used as stops for radially placed sample tubes. For keeping them in position against the stops the radially inner ends of the tube are pressed downwards in the middle of the rotor plate for changing the slope of the tubes to go through a dead center position. A hub in the middle of the rotor is joined with a driving shaft by a coupling. A nosepiece for use with a locking part is arranged on a part, fixedly joined to the driving shaft, of the coupling.

6 Claims, 5 Drawing Figures

APPARATUS FOR SEPARATING AND MEASURING SAMPLE COMPONENTS

BACKGROUND OF THE INVENTION (1) Field of the Invention

The invention relates to the apparatus of the kind disclosed in U.S. Pat. No. 4,052,165, granted Oct. 4, 1977, for separating by centrifugal force the components of samples and then measuring them. The samples are placed in rod-like vessels and are kept in place by means of a fixing part in radial recesses of a plate-like rotor of the apparatus. The fixing part is able to be moved in the axial direction of the rotor and is acted upon by a return spring having a tendency to keep it in a first stop position for putting in the vessels before they are fixed in position. The fixing part has in it at least one locking part for use with a locking nosepiece on the rotor and which keeps the fixing part in a second stop position, once the vessels have been fixed in position, against the effect of the return spring.

(2) Overview of the Invention

One purpose of the present invention is that of making such a further development of the apparatus of the main patent application that in one form of the apparatus the plate-shaped rotor is able to have its place taken by another one. For effecting this purpose the rotor plate is able to be joined with the driving shaft by a driving coupling able to be undone, and the nosepiece for use with the locking part is placed on the part, fixedly joined to the driving shaft, of the driving coupling. One good effect of being able to make use of one or more different rotor plates is that of ready cleaning of dirt from the rotor. Such dirt is produced by putting in place and taking out full capillary tubes or vessels a number of times. The cleaning made possible by the invention takes place in a very simple manner after the rotor has been taken off, without making the other parts of the apparatus dirty. Furthermore the use of an other rotor plate as a single part in place of the rotor plate which has been damaged by wear after being used for a long time, is readily possible. This is specially important with respect to low-price servicing and putting in new parts.

In a more particular form of the invention the driving coupling is so designed that the taking off of the rotor plate together with the fixing part and the locking lever is possible by pulling out in the direction of the driving shaft.

A coupling and locking system, which is able to be made with the least number of parts, is made possible by an other measure of the invention because the part, fixedly joined to the driving shaft, is in the form of a coupling part with axially running coupling teeth, which go into the necessary coupling grooves in the rotor plate, and the edge of the coupling part is designed on the one hand as a support for the rotor plate and on the other hand as locking nosepiece for use with the locking lever. This is a form of the invention of good effect in which parts of the coupling shaft is outside the coupling piece and at this position makes for a guide pin, on which the hub of the rotor plate is guided. The hub is made longer in the middle.

LIST OF FIGURES OF THE DRAWINGS

An account is now given of one form of the invention by way of example as is to be seen in the drawings.

ACCOUNT OF FORM OF THE INVENTION

Figure 2:
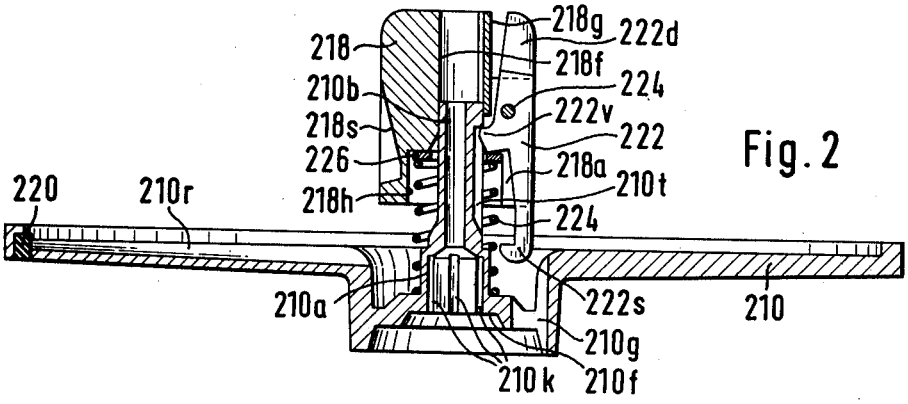
FIG. 2 is a section on the line II—II of FIG. 1.
Figure 3:
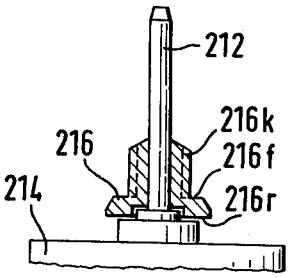
FIG. 3 is a view of the driving shaft on the apparatus and used for driving the rotor plate.
Figure 1:
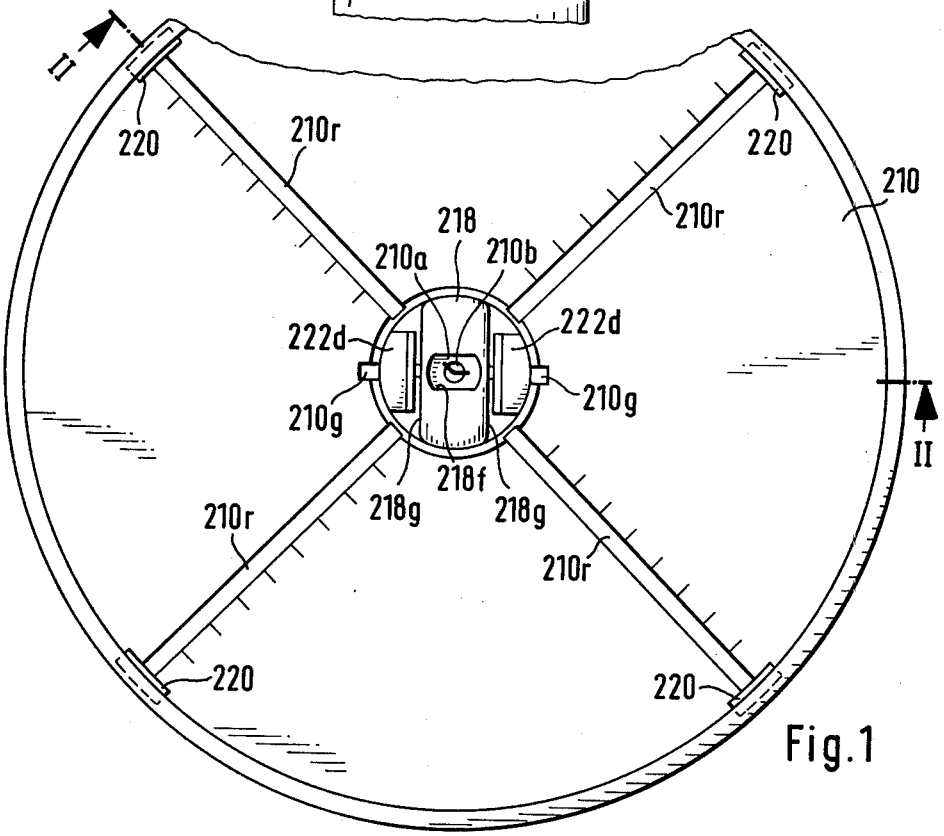
FIG. 1 is a view from above of a rotor plate by itself.

The rotor plate 210 has four radially running positioning grooves **210*r* or recesses for taking up capillary tubes, of which an account will be given presently. In the inside of its hub 210*a* there are some machined axially running coupling grooves 210*k*, joining up with a middle guide hole 210*b***.

The driving shaft 212, which is powered by an electric motor not to be seen in the drawings, is journalled in the housing part 214. A coupling part 216 is fixedly joined to this shaft. At the outer edge of the middle part of the coupling part 216 there are some axially running coupling teeth **216*k*, while the flange 216*f* is used as a stop-face. When the rotor plate 210 has been placed on the shaft 212, the coupling teeth 216*k* are joined up with the coupling grooves 210*k* as needed for the turning force. The rotor plate 210 has its face 210*f* resting on the flange 216*f*. The hole 210*b*, which is made somewhat longer in the axial direction, has the driving shaft 210** in it.

Figure 4:
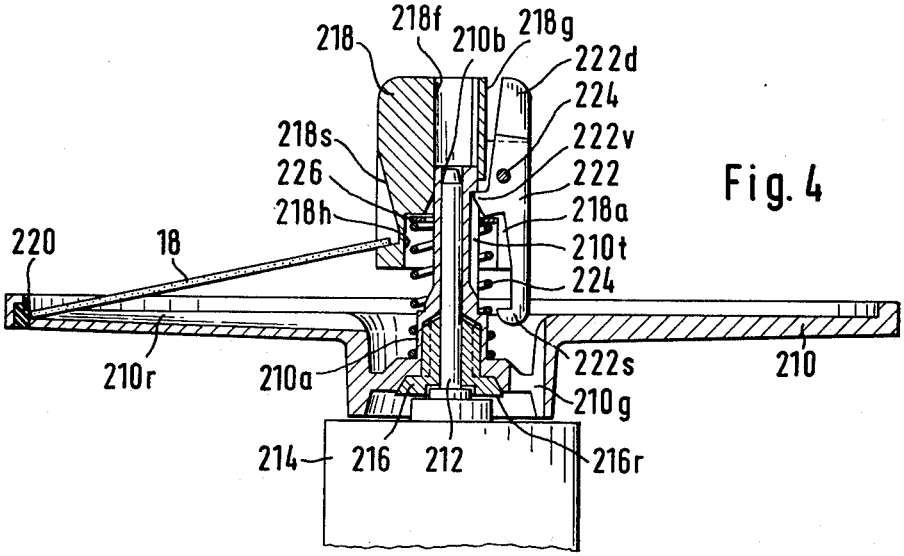
FIGS. 4 and 5 are views of two different positions of the rotor plate and the parts used with it.
Figure 5:
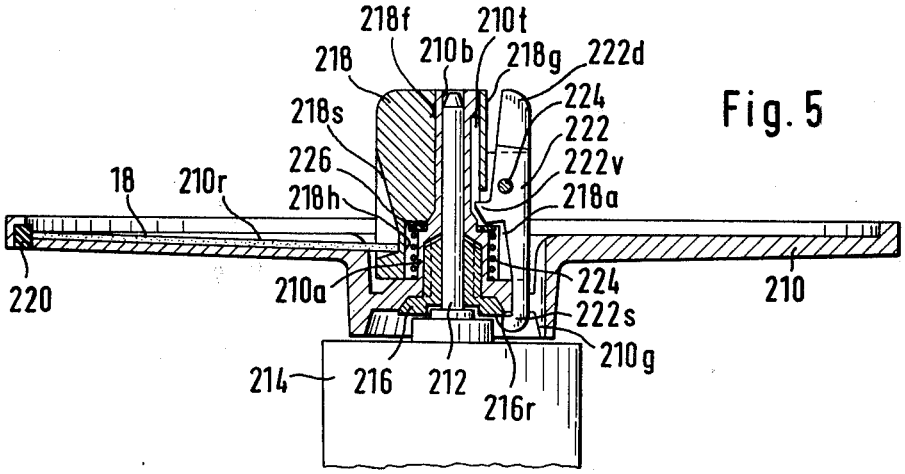

The hub **210*a* of the rotor plate 210 has a part which gets thinner, is made longer in the axial direction and on its two sides is made flat. At the outer edge of this part a cylindrical fixing part 218 is placed slipping over this part of the hub. The middle hole 218*f* of the part 218 has an outline which is the same as the hole in the hub 210*a*. The outer part of the fixing part 218 has four axially running slots 218*s*. A capillary tube 18 in the position seen in FIG. 4 is able to have its one end put in one of the slots 218*s*, while its other end is kept in position by a sealing plug 220 on the inside of the outer edge part of the rotor plate 210. On pressing down the fixing part 218 into the position seen in FIG. 5 the slope of the capillary tubes is changed and the tubes are forced radially outwards by the working face of the slot 218*s*. The outcome is that the capillary tubes are pressed against the plugs 220**.

The fixing part 218 has two diametrally opposite locking levers 222, of which only one is to be seen in FIG. 2. For each locking lever 222 an axially running slot **218*a* is machined in the fixing part 218, in which the flat part of the locking lever 222 is guided. A cross-pin 224 is used in this case as a bearing for the locking lever 222. A nosepiece 222*v* of the locking lever 222 goes into an axially running guide groove 210*t* in the outer part of the hub 210*a*, while its other nosepiece 222*s* has the form of a locking nosepiece, which is able to take its place under the edge 216*r* of the coupling part 216. The upper end 222*d* of the locking lever 222 is made broader and as a handle is able to be moved towards a flat part 218*g* above the slot 218*a***.

A return spring 224 is placed around the hub **210*a* and has its one end resting against the rotor plate 210. The other end of the spring 224 goes up against a spring plate 226 which is placed inside a hollow 218*h* of the fixing part 218 and its force comes into play from below against the nosepiece 222*v* of the locking lever 222. The outcome is that in the position of operation to be seen in FIG. 2 the nosepiece 222*v* is pressed against the top end of the groove 210*t* in the hub 210*a* and the parts 210, 218, and 222 are kept in position by the force of the spring 224**, that is to say the position to be seen in this figure.

A through-hole 210*g* is present under each locking lever 222 in the rotor plate 210 so that the locking nosepiece 222*s* is able to go through the hole in a certain position of operation.

Before putting the apparatus into use the rotor plate 210, in the position to be seen in FIG. 2, is to be put on the driving shaft so that the coupling parts 210*k* and 216*k* are joined up with each other for the coupling function as is to be seen in FIG. 4. Then four capillary tubes 18 are to be placed in the rotor plate 210. When the fixing part 218 has been pressed downwards by the person using the apparatus, that is to say towards the wall 214 of the apparatus, the four capillary tubes 18 are fixed in position in the rotor plate 210 in the way noted earlier and the locking nosepiece 222*s* of the locking lever 222 after going through the hole 210*g* is acted upon by the spring 224 so as to take up its position under the edge 216*r* of the coupling part 216, as is to be seen in FIG. 5. The locking effect at 222*s* and 216*r* makes certain on the one hand the keeping in position of the capillary tubes 18 in the rotor plate 210 and on the other hand also makes certain that the rotor plate 210 is kept in the desired axial position on the driving shaft 212.

After the centrifuging operation has been run to an end, in which the parts are caused to turn at a high speed for, for example, some minutes, the person using the apparatus takes the two locking levers 222 at their handles 222*d* and by pressing them inwards the two locking levers 222 are changed in slope. The locking effect at 222 and 216*r* is now no longer in existence and under the effect of the spring 224 the fixing part 218 is moved upwards into the position to be seen in FIG. 4. The capillary tubes 18 with the centrifuged material in them are now able to be taken from the rotor plate 210 again.

If it seems necessary to take the rotor plate 210 off from the rest of the apparatus, for example for the purpose of cleaning the grooves 210*r* and nearby parts, the user will take the fixing part 218 in his hand for pulling the rotor plate 210 out of the position of FIG. 4 upwards till the rotor parts come into the uncoupled position to be seen in FIG. 2.

It will be readily seen that the uncoupling of the rotor plate from its drive and taking it off from the rest the apparatus is readily possible. For this reason there is no complex servicing of the apparatus. Little time is needed for servicing. On the other hand the fixing in place of the rotor plate in the operation position automatically takes place when the capillary tubes are fixed in position so that from this point of view the user does not have to give the apparatus any special attention during use.

I claim:

1. A centrifugal device for analyzing samples, comprising a driving shaft (212), a coupling part (216) fixed to said shaft, said coupling part having axially extending coupling teeth (216*k*), a plate shaped rotor (210) for receiving capillary tubes arranged radially on the rotor to enable centrifugal force to be applied to the contents of such tubes, said rotor having a central opening for receiving said coupling part and having coupling grooves (210*k*) mating with said coupling teeth of said coupling part when said rotor is seated on said coupling part, said rotor being removable in an axial direction from said coupling part, a fixing part (218) movable axially with respect to said shaft, said fixing part having portions for engaging and holding the inner ends of capillary tubes arranged radially on said rotor, a spring (224) tending to move said fixing part axially away from said rotor, and a locking lever (222) pivotally mounted on said fixing part and having a nose (222*s*) for engaging a portion of said coupling part to latch said fixing part in an operative position close to said rotor against the force of said spring.

2. The invention defined in claim 1, wherein said driving shaft passes axially through and projects a substantial distance beyond said coupling part, the projecting part of said shaft serving as a guiding pin to facilitate setting the rotor in place on said coupling part.

3. The invention defined in claim 1, wherein said rotor has an axially extended hub, and said fixing part is mounted on said hub to move axially thereon.

4. The invention defined in claim 3, wherein said locking lever has a second nose (222*v*) and said hub has an abutment engaging said second nose to limit the extent to which said fixing part may travel along said hub in a direction away from said rotor.

5. The invention defined in claim 4, wherein said locking lever is so shaped and so located with respect to said spring that said spring tends to maintain the first mentioned nose of said lever engaged with said coupling part whenever it is engaged therewith and tends to maintain said second nose in position to engage said abutment on said hub as said fixing part moves along said hub in a direction away from said rotor.

6. The invention defined in claim 1, wherein said coupling part includes a flange having one face on which said rotor rests when positioned in normal operating position on said coupling part, said flange also having another face engaged by said nose of said locking lever when said fixing part is latched in said operative position.

* * * * *